US007984528B2

(12) United States Patent
Giacolo et al.

(10) Patent No.: US 7,984,528 B2
(45) Date of Patent: Jul. 26, 2011

(54) CLEANING IMPLEMENT

(75) Inventors: Robert Giacolo, Naperville, IL (US); Norbert Weis, Heddesheim (DE); David McKnight, Hinsdale, IL (US)

(73) Assignee: Freudenberg Household Products LP, Aurora, IL (US)

( * ) Notice: Subject to any disclaimer, the term of this patent is extended or adjusted under 35 U.S.C. 154(b) by 354 days.

(21) Appl. No.: 12/167,928

(22) Filed: Jul. 3, 2008

(65) Prior Publication Data

US 2009/0113651 A1 May 7, 2009

Related U.S. Application Data

(60) Provisional application No. 60/984,995, filed on Nov. 2, 2007.

(51) Int. Cl.
*A46B 7/04* (2006.01)
*B25G 3/00* (2006.01)

(52) U.S. Cl. ..... 15/145; 15/176.1; 15/176.6; 16/422; 403/296; 403/298; 403/383

(58) Field of Classification Search ..... 15/145, 15/176.1, 176.2, 176.3, 176.6; 16/422, 436; 403/296, 298, 383
See application file for complete search history.

(56) References Cited

U.S. PATENT DOCUMENTS 110,325 A * 12/1870 Achew ..... 403/237
1,013,438 A * 1/1912 Post ..... 279/50
2,279,324 A 4/1942 Julien et al.
2,921,326 A * 1/1960 Lautmann ..... 15/145
3,423,781 A 1/1969 Henson
3,524,210 A * 8/1970 McLean ..... 15/145
3,682,516 A 8/1972 Savage
3,790,232 A * 2/1974 Alvarez ..... 403/192
4,169,297 A 10/1979 Weihrauch
4,371,282 A * 2/1983 Sturm ..... 403/277
4,373,828 A 2/1983 Sartori
(Continued)

FOREIGN PATENT DOCUMENTS

GB 2201627 * 9/1988
(Continued)

OTHER PUBLICATIONS

Photograph of two broom heads; Available to the public before Nov. 2, 2007.

*Primary Examiner* — Mark Spisich
(74) *Attorney, Agent, or Firm* — Leydig, Voit & Mayer, Ltd.

(57) ABSTRACT

A cleaning implement that includes a connector for connecting a handle to a base block. The connector prevents the handle from rotating relative to the base block and, thus, the connector prevents the handle from unscrewing or otherwise loosening or disconnecting from the base block. The base block can include a headpiece supported between oppositely arranged shoulders, a generally cylindrical flange projecting from the headpiece, and a generally cylindrical opening extending through the cylindrical flange. A slot may be formed in an inner surface of the cylindrical flange. A ferrule that can have a generally dovetail-shaped projection provided on its outer surface can be secured to an end of the handle. The projection and the slot can form a joint when the handle is connected to the base block. This joint substantially prevents the handle from rotating relative to the base block.

21 Claims, 8 Drawing Sheets

U.S. PATENT DOCUMENTS 4,433,931 A 2/1984 Malish et al.
4,538,318 A * 9/1985 Lammert et al. ..... 15/171
4,541,139 A 9/1985 Jones et al.
4,642,837 A 2/1987 Nichols et al.
4,767,135 A 8/1988 Holzmann
5,037,235 A 8/1991 Aquilina
5,161,278 A 11/1992 Tomm
5,172,447 A 12/1992 Tomm
5,385,420 A 1/1995 Newman, Sr. et al.
5,502,862 A 4/1996 Vosbikian
5,579,848 A * 12/1996 Hsu ..... 172/378
5,890,254 A 4/1999 Courtney et al.
5,924,816 A 7/1999 Schuele
6,247,199 B1 * 6/2001 Petner ..... 15/229.1
6,393,647 B1 5/2002 Libman
6,594,850 B2 7/2003 Libman et al.
2006/0195997 A1 9/2006 Young
2009/0049630 A1 * 2/2009 Haigh et al. ..... 15/145

FOREIGN PATENT DOCUMENTS

WO 93/14687 * 8/1993

* cited by examiner

CLEANING IMPLEMENT

CROSS-REFERENCE TO RELATED APPLICATION

This patent application claims priority to U.S. Provisional Patent Application Ser. No. 60/984,995, filed Nov. 2, 2007, which is incorporated by reference in its entirety herein.

BACKGROUND

Brooms with handles that screw directly into the broom block have been used for many years. Typically these brooms utilize a broom block having a threaded opening for receiving a threaded end of the broom handle. The threaded end screws directly into the threaded opening for connecting the handle to the broom block. These brooms have proved problematic in that, as an operator sweeps, the handle may rotate and inadvertently unscrew from the block.

BRIEF SUMMARY

A cleaning implement is disclosed that includes a connector for connecting a handle to a base block. The connector prevents the handle from rotating relative to the base block, and thus, the connector prevents the handle from unscrewing or otherwise loosening or disconnecting from the base block. The base block includes a headpiece supported between oppositely arranged shoulders, a generally cylindrical flange projecting from the headpiece, and a generally cylindrical opening extending through the generally cylindrical flange. A slot is formed in an inner surface of the cylindrical flange. The slot may be generally dovetail in shape. A projection may be disposed near an end of the handle. The projection may also have a generally dovetail shape. In some embodiments, a ferrule that has the projection provided on its outer surface can be secured to an end of the handle. The dovetail and the dovetail slot form a dovetail joint when the handle is connected to the base block. This dovetail joint prevents the handle from rotating relative to the base block.

DETAILED DESCRIPTION

Figure 1:
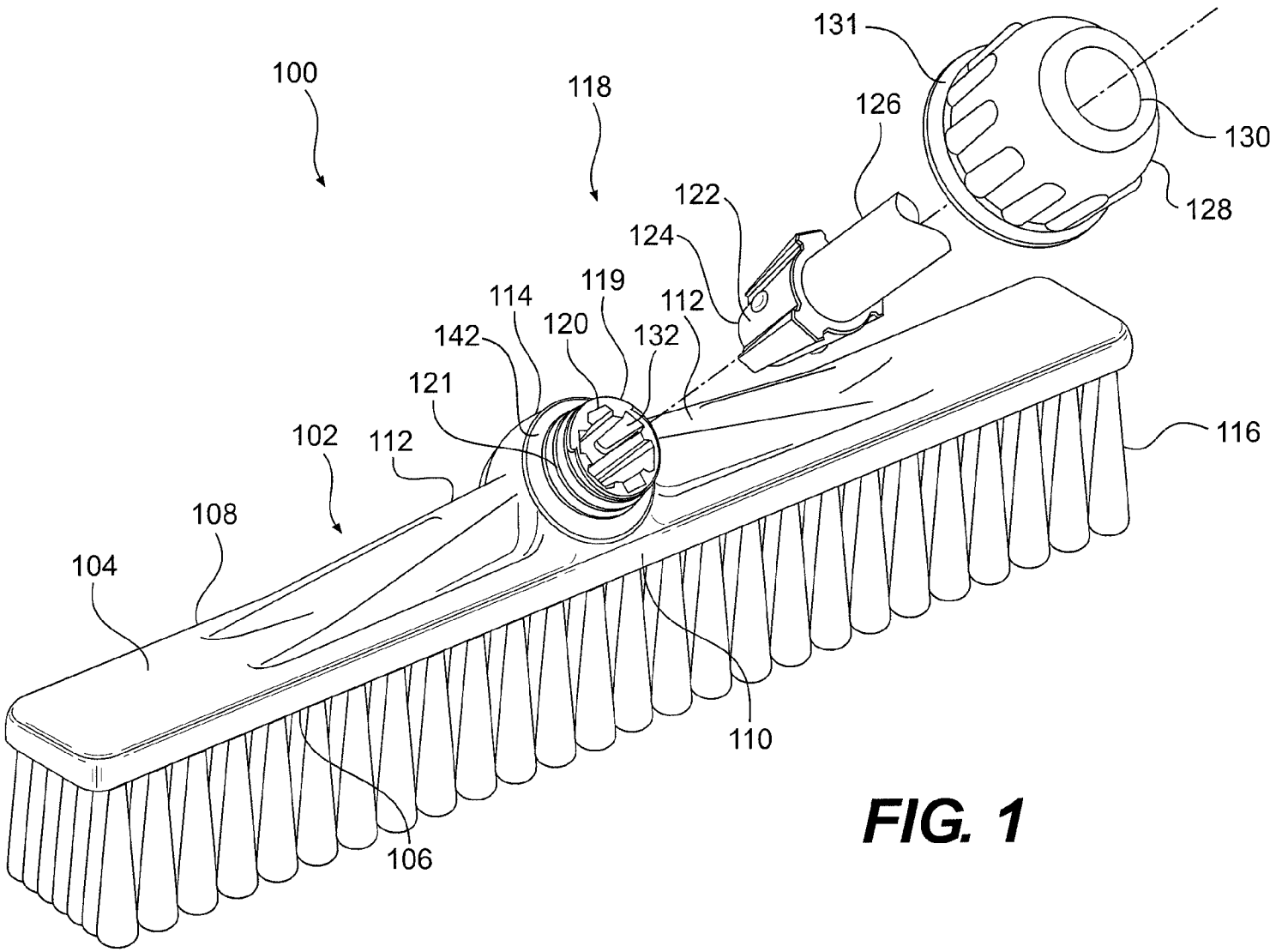
FIG. 1 is an exploded rear perspective view of a cleaning implement.

Referring to FIG. 1, an implement 100 is shown that includes a base block 102. In the illustrated embodiment, the implement 100 is represented as a broom assembly having a base block 102 that is a broom block. The base block 102 may include a handle side 104, a cleaning side 106, a front side 108, and a rear side 110. Oppositely arranged shoulders 112 may extend from the handle side 104 for, among other things, supporting a headpiece 114. In embodiments where the cleaning implement is a broom, a plurality of bristles 116 may extend from the cleaning side 106. A connector 118 may be located on the handle side 104. The connector 118 may include a generally cylindrical flange 119 that can extend from the headpiece 114. The cylindrical flange 119 may be integrally formed with the base block 102. An inner surface 132 of the cylindrical flange 119 may define a generally cylindrical opening 120 for receiving a handle 126. The cylindrical opening 120 may be sized to receive a collar-like structure such as a ferrule 122, which can be fixed near an end 124 of the handle 126. The connector 118 may include a threaded fastening cap 128 for engaging an outer surface 121 of the cylindrical flange 119 and thereby securing the ferrule 122 inside of the opening 120. The threaded fastening cap 128 can include an opening 130 through which the handle 126 extends and a lip 131 that may abut the headpiece 114 when the cleaning implement 100 is assembled.

Figure 2:
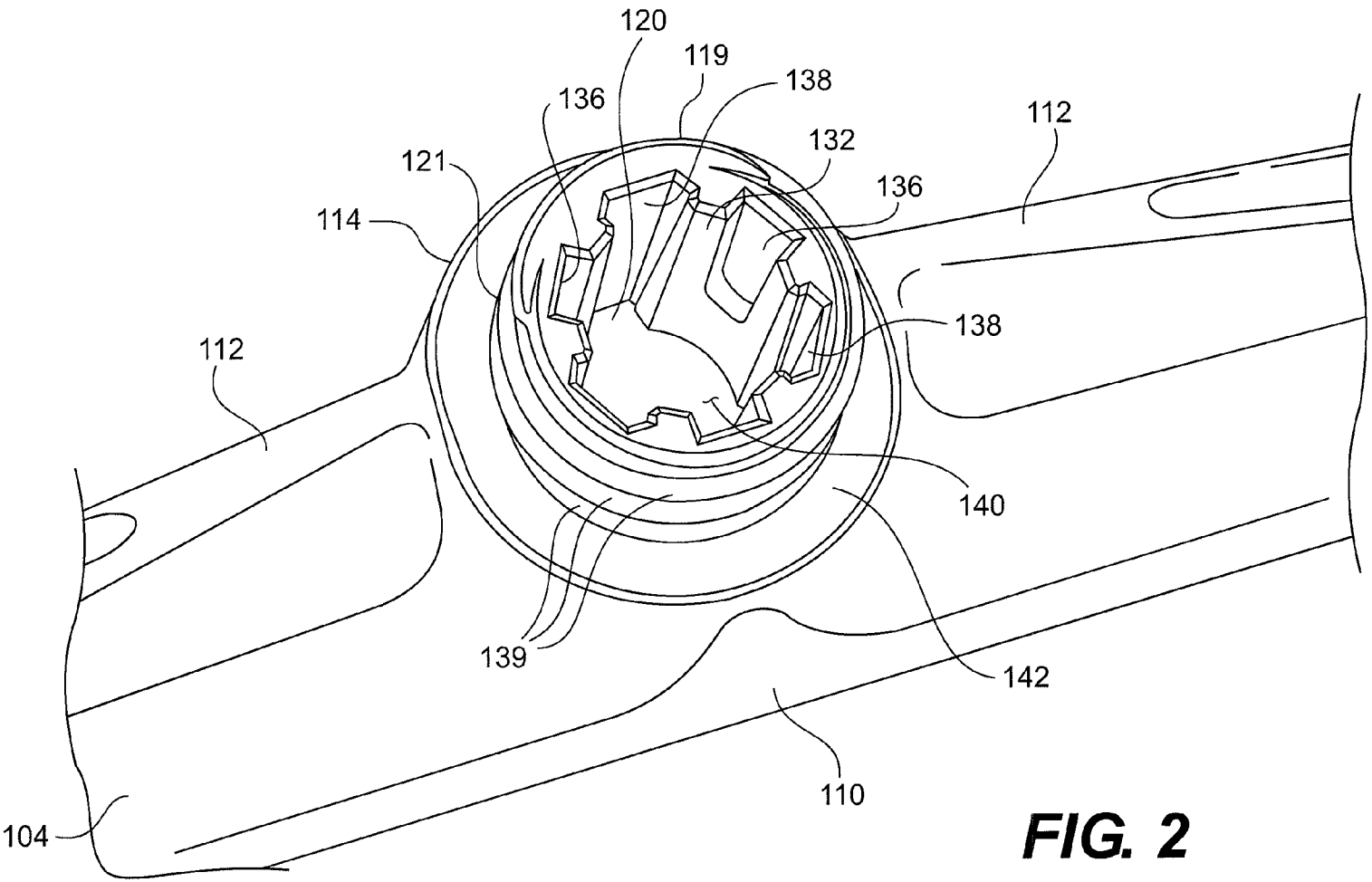
FIG. 2 is a fragmentary rear perspective view of the base block shown in the cleaning implement of FIG. 1.

Referring to FIG. 2, one or more first and/or second receiving slots 136, 138 may be formed in, and circumferentially spaced about, the inner surface 132 of the cylindrical flange 119. In the illustrated embodiment, the receiving slots 136 have a generally rectangular shape in cross-section and the receiving slots 138 have a generally dovetail shape in cross-section. It will be appreciated, however, that the receiving slots 136, 138 may have any suitable shape or size. Threads 139 may be provided on the outer surface 121 of the cylindrical flange 119 for engaging inner threads of the threaded fastening cap 128. The headpiece 114 may include stop surfaces 140, 142. The inner surface 132 of the cylindrical flange 119 can define the outer perimeter of stop surface 140 and the outer surface 121 of the flange 119 can define the inner perimeter of stop surface 142. Accordingly, the cylindrical flange 119 may separate stop surfaces 140 and 142. In the illustrated embodiment, stop surfaces 140, 142 are generally flat surfaces that are disposed in planes that are parallel to each other. It will be appreciated, however, that the stop surfaces may have any suitable shape and may be disposed in any suitable orientation. Stop surface 140 may be disposed in a plane below the plane in which stop surface 142 is disposed. Accordingly, stop surface 140 can be recessed in the headpiece 114. When the handle 126 is connected to the base block 102, the lower end 124 of the handle 126 or ferrule 122 may abut stop surface 140 and the lip 131 of the securing cap 128 may abut stop surface 142.

Figure 4:
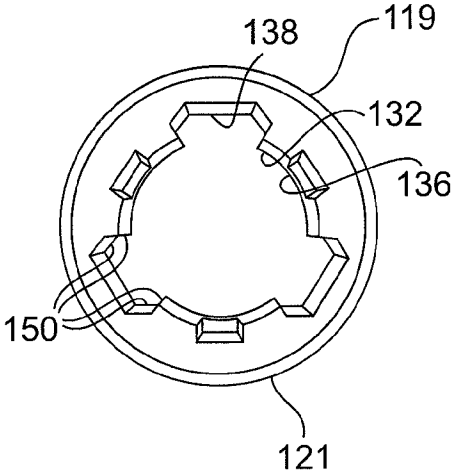
FIG. 4 is a plan view of the connector shown with the base block of FIG. 2.
Figure 3:
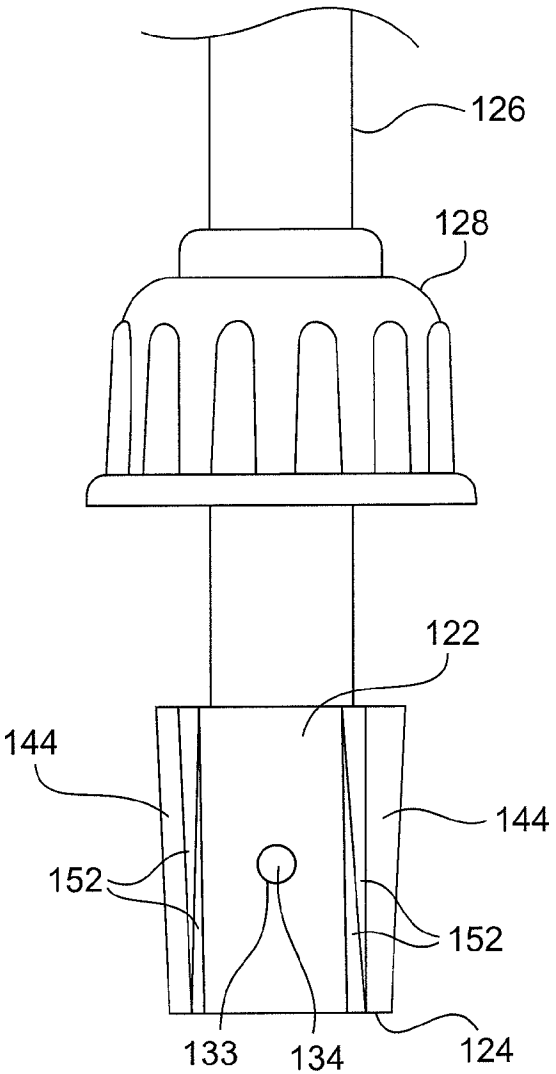
FIG. 3 is a fragmentary elevational side view of the cleaning implement handle and securing cap shown in the cleaning implement of FIG. 1.

Referring to the embodiments shown in FIGS. 3 and 4, one or more screws, such as screw 133, can be circumferentially spaced about the ferrule 122 in a manner that corresponds to the locations of the slots 136 formed in the inner surface 132 of the cylindrical flange 119. The screw 133 may radially extend through the ferrule 122 and into the handle 126 so as to secure the ferrule 122 to the lower end 124 of the handle 126. Each respective screw 133 includes a screw head 134 that projects radially outward from the collar 122. As will be appreciated, the ferrule 122 can be secured to the end of the handle in any suitable manner including, but not limited to, other types of fasteners or adhesives. In some embodiments, the ferrule 122 may be integrally formed with the handle. Furthermore, the ferrule 122 may be constructed of any suitable material, including, but not limited to, plastic or metal.

One or more projections 144 may be circumferentially spaced about the ferrule 122 in a manner that corresponds to the locations of the slots 138. In the illustrated embodiment, the projections 144 are represented as having a generally dovetail shape in cross-section. It will be appreciated, however, that the projection(s) may have any suitable shape or size. Each slot 138 may include one or more angled edge 150 that corresponds to angled edge 152 of the projections 144. Accordingly, the slots 138 and the projections 144 can form a joint when the handle 126 is connected to the base block 102. This joint prevents the handle 126 from rotating within the cylindrical opening 120.

Figure 5:
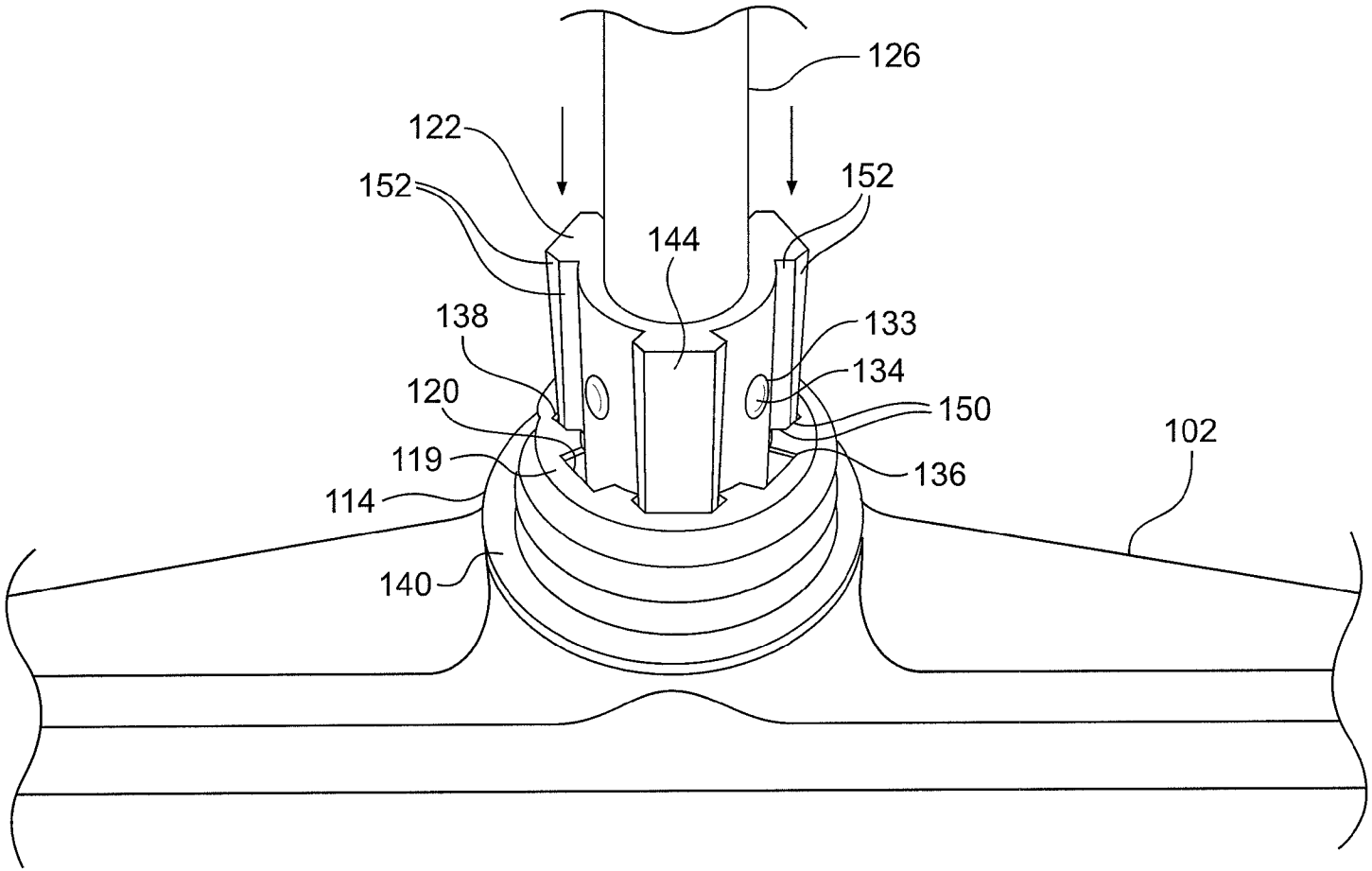
FIG. 5 is a fragmentary rear view of the cleaning implement of FIG. 1 showing the cleaning implement being inserted into the connector of the base block.

Referring to FIG. 5, to assemble the cleaning implement 100, an operator inserts the handle 126 into the base block 102. More specifically, the operator may insert the ferrule 122 into the opening 120. During assembly, the slots 136 can receive any corresponding screw heads 134 and the slots 138 can receive corresponding projections 144. The slots 136, 138 and projections 144 may be tapered such that screw heads 134 and projections 144 can enter the slots 136, 138, and the connection can become tighter as the handle 126 moves downward into the cylindrical opening 120 and toward the stop surface 140. If the ferrule is connected to the handle using fasteners or a fastening system that does not have protruding fastener heads or is integrally formed with the handle, the slots 136 may be excluded.

Figure 6:
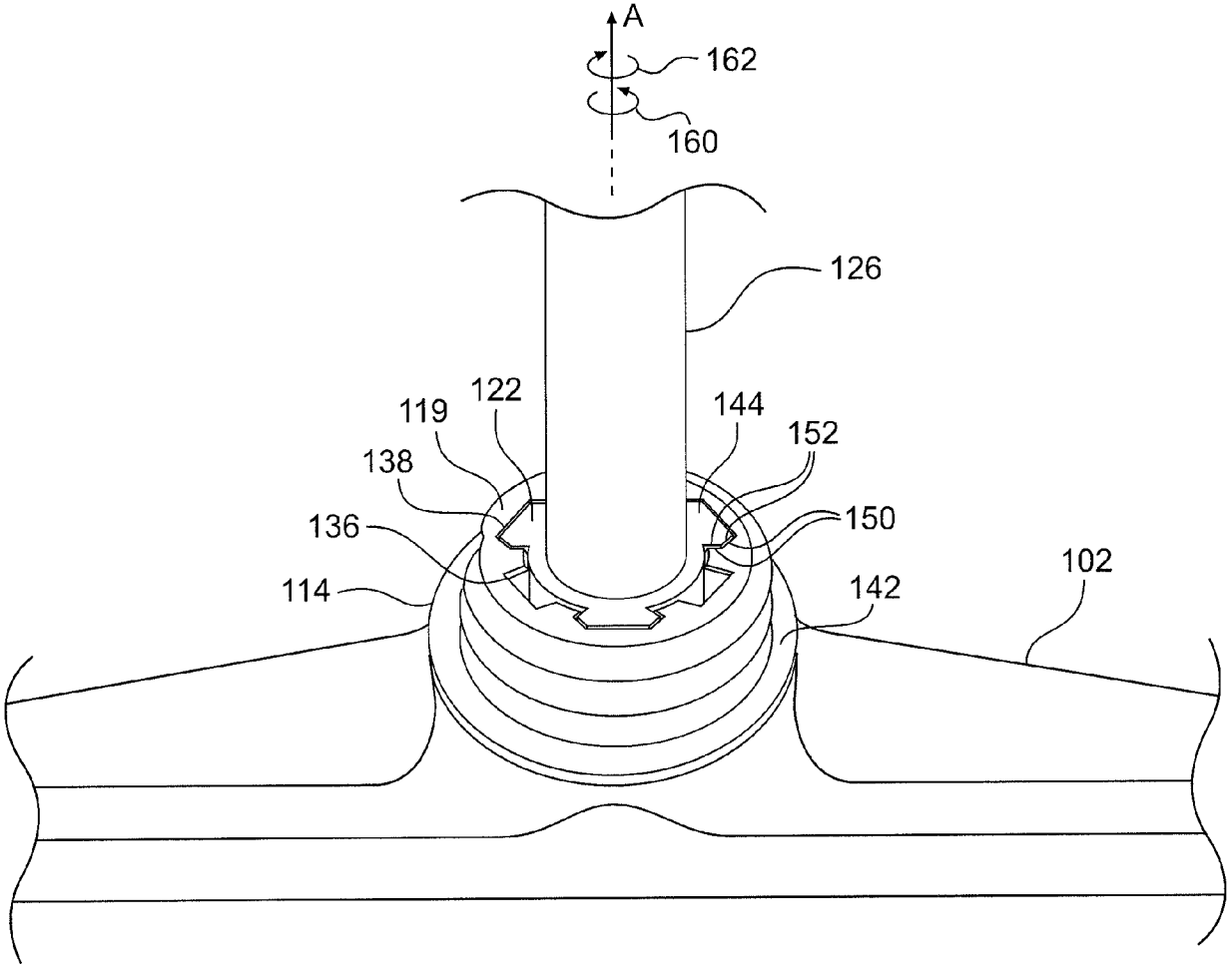
FIG. 6 is a fragmentary rear view of the cleaning implement of FIG. 1 showing the cleaning implement handle disposed in the connector of the base block.

Referring to FIG. 6, when the handle 126 is disposed in the base block 102, the end 124 of the handle 126 may abut the stop surface 140. Additionally, once the handle 126 is disposed within the base block 102, the slots 138 can combine with the projections 144 to form a joint that prevents the handle 126 from rotating relative to the base block 102 in either direction 160, 162 about axis A. This prevents the handle from loosening or disconnecting during cleaning, such as when the cleaning implement is used for sweeping.

Figure 7:
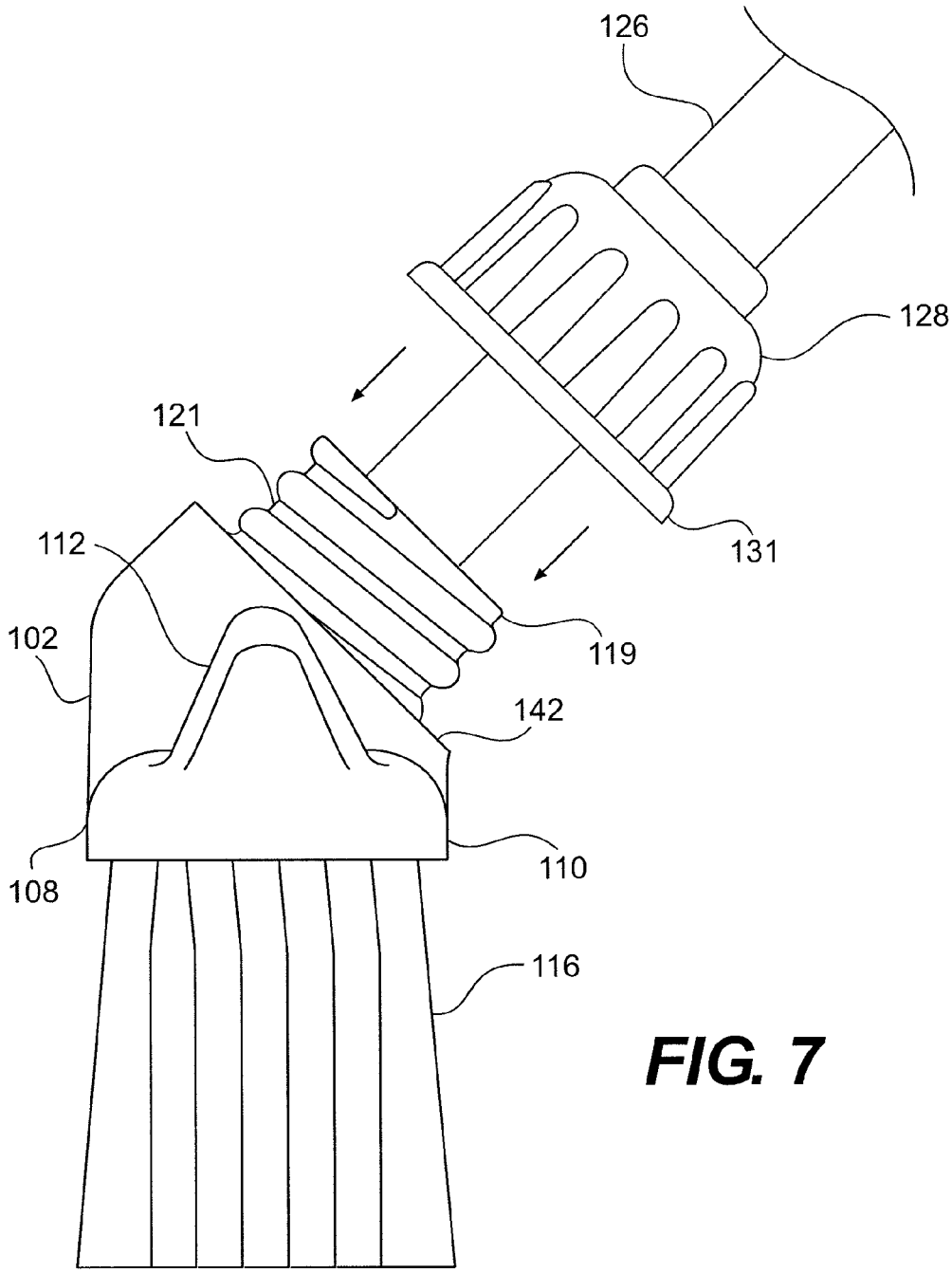
FIG. 7 is a side view of the cleaning implement of FIG. 1 showing the cleaning implement handle disposed in the connector and a securing cap moving toward the connector.
Figure 8:
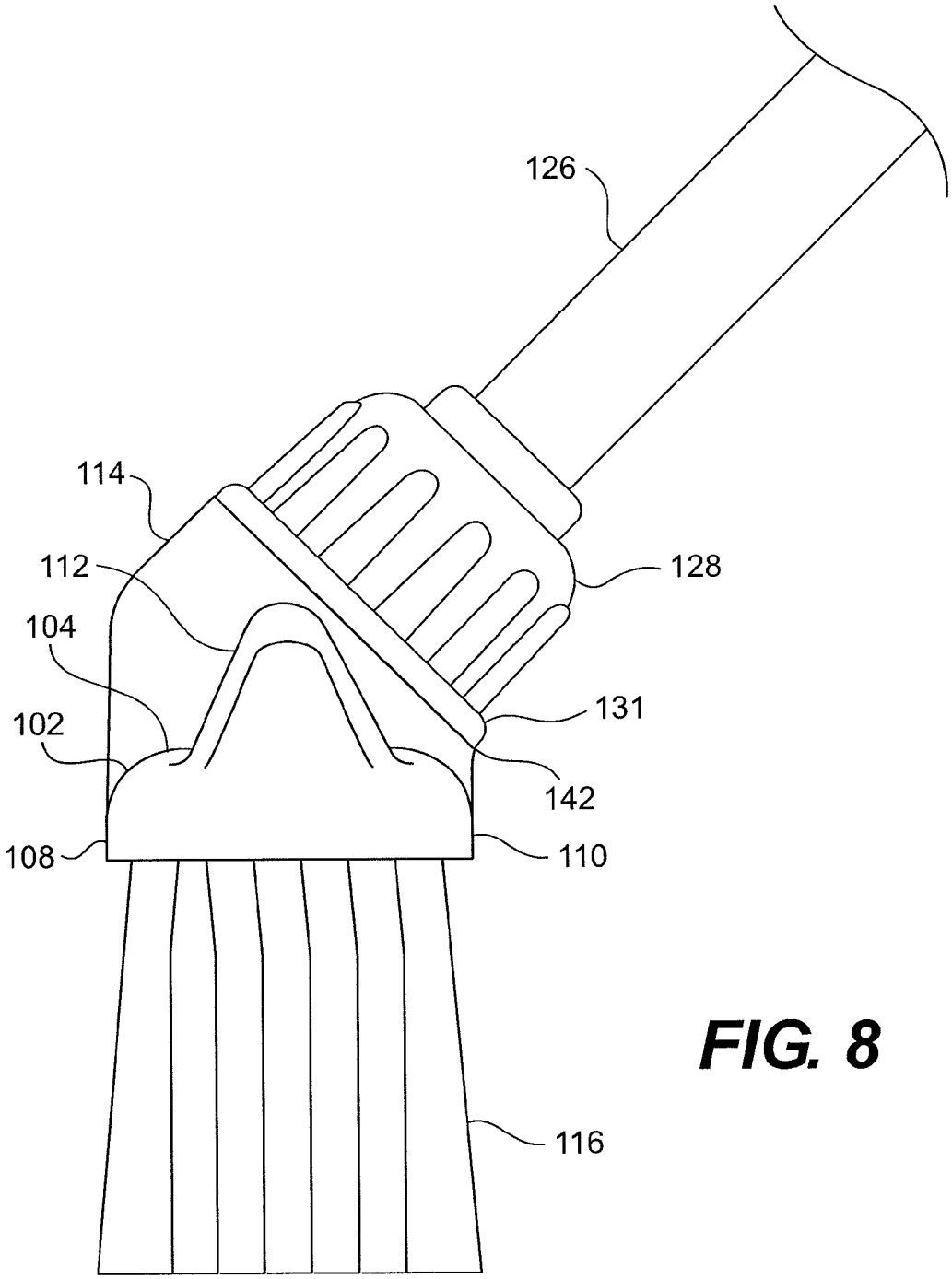
FIG. 8 is a side view of the cleaning implement of FIG. 1 showing the cleaning implement handle disposed in the connector of the base block and the securing cap being secured to the connector.
Figure 9:
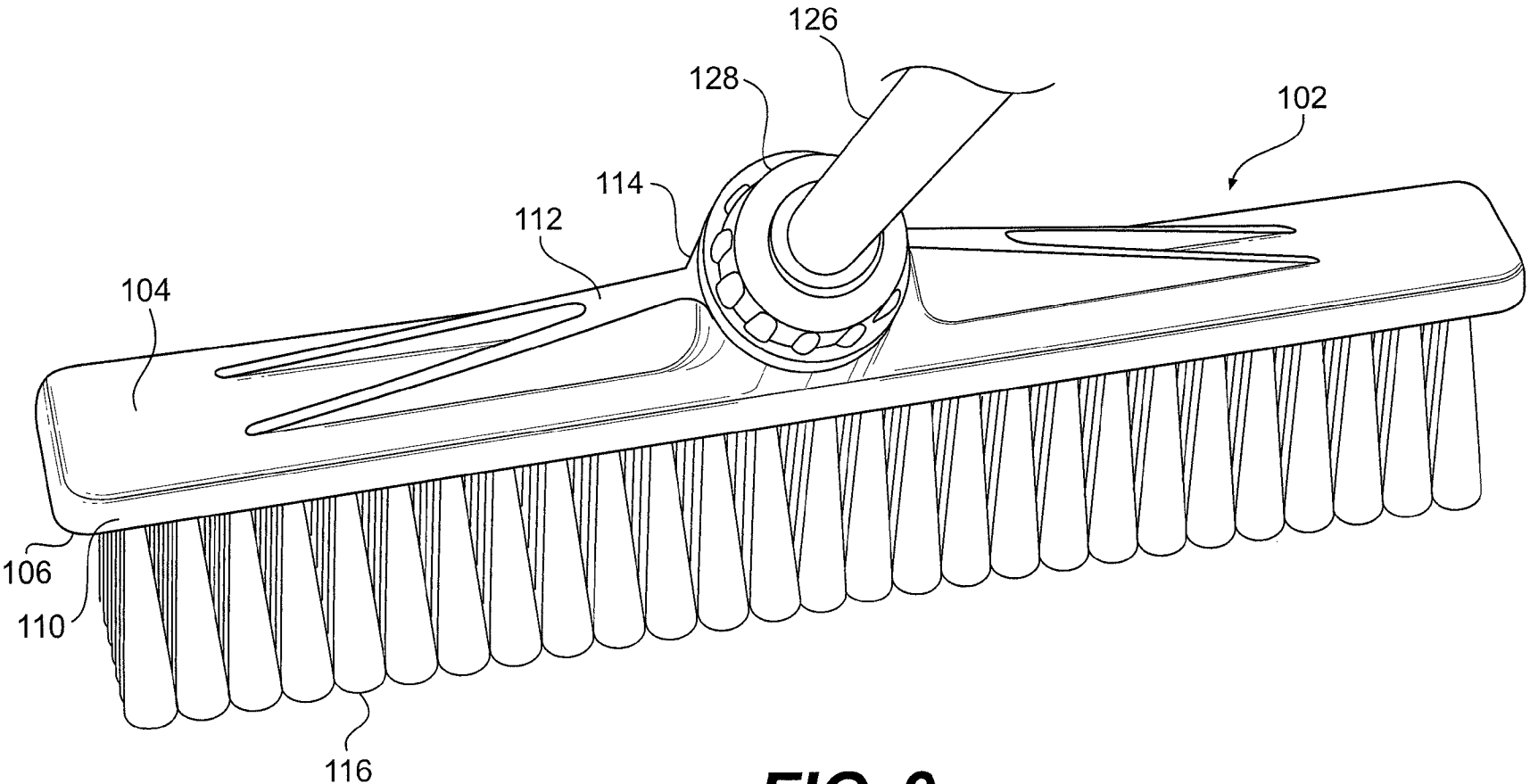
FIG. 9 is a rear perspective view of the cleaning implement of FIG. 1.

Referring to FIG. 7, after inserting the handle 126 into the cylindrical opening 120, an operator may slide the securing cap 128 toward the flange 119. When the securing cap 128 contacts the flange 119, the operator can screw the cap 128 onto the outer surface 121 of the flange 119. The cap 128 may be securely fastened to the flange 119 when the lip 131 abuts the second stop surface 142, as shown in FIGS. 8 and 9.

The connection between the handle 126 and the base block 102 of the cleaning implement 100 will not loosen during cleaning. In part, this is because the handle is not screwed into the base block 102. Instead, the projections 144 of the handle can form a joint with the slots 138 of the base block 102 such that the handle 126 will not partially or completely unscrew from the base block during cleaning operations. This prevents delays and extends the durability and use life of the cleaning implement.

It will be appreciated that in some embodiments the cylindrical flange may include the projection and the handle or ferrule may include the slot to form a joint. The embodiments and features described herein may be utilized with any suitable type of cleaning implement. Accordingly, by way of example and not limitation, the connector 118 may be used with cleaning implements such as brooms, brushes, mops, dusters, etc. Additionally, it will be appreciated that many of the described embodiments and features may be combined with each other to create further embodiments of the cleaning implement. Accordingly, any of the features discussed in the herein described embodiments and features may be included in any other suitable embodiments.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A cleaning implement, comprising:

a base block having a headpiece disposed between oppositely arranged shoulders;

a generally cylindrical flange projecting from the headpiece;

a generally cylindrical opening extending at least partially through the generally cylindrical flange;

a plurality of slots formed in an inner surface of the generally cylindrical flange, each slot having a generally dovetail shape and being tapered;

a handle, the handle including a plurality of projections each having a generally dovetail shape and being tapered, the projections extending radially outward relative to a side of the handle in a direction substantially perpendicular to a longitudinal axis of the handle; and wherein the projections and the slots form a joint when the handle is coupled to the base block, the joint substantially preventing the handle from rotating relative to the base block.

2. The cleaning implement of claim 1, further comprising:

a threaded fastening cap having an opening through which the handle extends, the fastening cap configured to engage a threaded outer surface of the cylindrical flange for securing the handle to the base block.

3. The cleaning implement of claim 2, wherein the headpiece includes a stop surface that forms an end of the cylindrical opening.

4. The cleaning implement of claim 3, wherein an end of the handle abuts the stop surface when the handle is connected to the base block.

5. The cleaning implement of claim 2, wherein the headpiece includes a stop surface, and the fastening cap has a lip that abuts the stop surface when the fastening cap is engaged with the threaded outer surface of the cylindrical flange.

6. The cleaning implement of claim 1, wherein the handle includes a ferrule disposed near an end of the handle, the projections being disposed on the ferrule.

7. The cleaning implement of claim 6, wherein a screw secures the ferrule near the end of the handle, the screw having a screw head that radially projects from the ferrule.

8. The cleaning implement of claim 7, wherein a second slot is formed in the inner surface of the cylindrical opening for receiving the screw head when the handle is connected to the base block.

9. A connector for a cleaning implement, the connector connecting a handle to a base block to substantially prevent the handle from rotating relative to the base block, the connector comprising:

a plurality of first slots formed in, and circumferentially spaced about, an inner surface of a generally cylindrical flange that extends from the base block, each first slot having a tapered edge;

a plurality of projections arranged on and circumferentially spaced near an end of the handle in a manner that corresponds to the first slots formed in the cylindrical flange, each projection having a tapered edge;

a ferrule secured to the end of the handle by a fastener, the projections being arranged on, and circumferentially spaced about, the ferrule, a second slot being formed in the inner surface of the cylindrical flange for accommodating a head of the fastener; and a threaded fastening cap having an opening to receive the handle, the fastening cap configured to engage a threaded outer surface of the cylindrical flange.

10. The connector of claim 9, further comprising a headpiece and wherein the headpiece includes a first stop surface.

11. The connector of claim 10, wherein the handle abuts the first stop surface when the handle is connected to the base block.

12. The connector of claim 10, wherein the first stop surface is recessed into the headpiece.

13. The connector of claim 10, wherein the headpiece further comprises a second stop surface and wherein the fastening cap has a lip that abuts the second stop surface when the fastening cap is engaged with the threaded outer surface of the cylindrical flange.

14. The connector of claim 9, wherein the first slots and the projections each have a generally dovetail shape.

15. The connector of claim 9, wherein the plurality of projections engage the plurality of first slots to substantially prevent rotational movement of the handle with respect to the cylindrical flange.

16. A cleaning implement, comprising:

a base block having a headpiece disposed between oppositely arranged shoulders;

a generally cylindrical flange projecting from the headpiece;

a generally cylindrical opening extending at least partially through the generally cylindrical flange;

a first slot formed in an inner surface of the generally cylindrical flange, the first slot having a generally dovetail shape;

a handle, the handle including a projection having a generally dovetail shape;

a ferrule secured to the end of the handle by a fastener, the projection being arranged on, and circumferentially spaced about, the ferrule, a second slot being formed in the inner surface of the cylindrical opening for accommodating a head of the fastener; and wherein the projection and the first slot form a joint when the handle is coupled to the base block, the joint substantially preventing the handle from rotating relative to the base block.

17. The cleaning implement of claim 16, further comprising:

a threaded fastening cap having an opening through which the handle extends, the fastening cap configured to engage a threaded outer surface of the cylindrical flange for securing the handle to the base block.

18. The cleaning implement of claim 17, wherein the headpiece includes a stop surface that forms an end of the cylindrical opening.

19. The cleaning implement of claim 18, wherein an end of the handle abuts the stop surface when the handle is connected to the base block.

20. The cleaning implement of claim 17, wherein the headpiece includes a stop surface, and the fastening cap has a lip that abuts the stop surface when the fastening cap is engaged with the threaded outer surface of the cylindrical flange.

21. The cleaning implement of claim 16, wherein the first slot and the projection are tapered.

* * * * *